US005479153A

United States Patent [19]

Yi et al.

[11] Patent Number: 5,479,153

[45] Date of Patent: Dec. 26, 1995

[54] METHOD AND APPARATUS FOR DISPLAYING AN OBJECT

[75] Inventors: Zhang Yi; Steven J. Ellingson, both of Reedsburg, Wis.

[73] Assignee: Hankscraft Motors, Inc., Reedsburg, Wis.

[21] Appl. No.: 143,259

[22] Filed: Oct. 26, 1993

[51] Int. Cl.[6] ..... G08B 5/00

[52] U.S. Cl. ..... 340/815.87; 340/815.58; 345/31

[58] Field of Search ..... 40/442, 443, 430, 40/446, 473; 345/31, 56, 57; 340/815.87, 815.83, 815.86, 815.88, 815.58

[56] References Cited

U.S. PATENT DOCUMENTS

| | | | |
|---|---|---|---|
| 2,762,040 | 9/1956 | Fryklund | 340/815.87 |
| 3,096,504 | 7/1963 | Fieldgate | 340/815.87 |
| 3,097,261 | 7/1963 | Schipper | 345/31 |
| 3,766,729 | 10/1973 | Diersbock | 368/86 |
| 3,798,640 | 3/1974 | Dill | 340/815.58 |
| 4,219,825 | 8/1980 | Heyraud et al. | 346/101 |
| 4,470,213 | 9/1984 | Thompson | 40/473 |
| 4,565,022 | 1/1986 | Chapin | 40/442 |
| 4,639,081 | 1/1987 | O'Brien | 345/31 |
| 5,012,160 | 4/1991 | Dunn et al. | 313/149 |
| 5,207,349 | 5/1993 | Kringel | 221/15 |
| 5,367,808 | 11/1994 | Liebman | 40/473 |

*Primary Examiner*—Curtis Kuntz
*Assistant Examiner*—Minsun Oh
*Attorney, Agent, or Firm*—Michael, Best & Friedrich

[57] ABSTRACT

An advertising display including a display object, a motor connected to the display object for rotating the object about a rotation axis, and a control circuit coupled to the motor. The control circuit includes a direct current energy source, and an oscillator connected to the energy source for generating a predetermined series of regularly timed energy pulses having a selected frequency and duty cycle to cause excitation of the motor in response to the energy pulses.

19 Claims, 2 Drawing Sheets

METHOD AND APPARATUS FOR DISPLAYING AN OBJECT

BACKGROUND OF THE INVENTION

The invention relates to a method and apparatus for displaying an object and particularly to a method and apparatus for displaying a point-of-purchase display object for rotation to enhance the visibility of the display object.

It is commonly known in the art to display an advertising display object at the point of purchase to attract the attention of prospective purchasers. It is also known in the art to mount the display object for rotational movement. The movement of the display object renders the object more noticeable to prospective purchasers. Typically, the rotation of the object is effected by connecting the display object to the drive shaft of a low power, direct current electric motor. The motor is typically powered using a commonly available electric battery.

However, ordinary low power, direct current electric motors typically operate at a speed of approximately one thousand rotations per minute or more. Because a sign rotating at such a speed is difficult, if not impossible, to read, a transmission or gearing system is usually connected between the rotating display and the motor to reduce the speed of the rotating object.

SUMMARY OF THE INVENTION

The need to employ a transmission between the rotating object and the drive shaft of the motor increases both the cost and complexity of the device. Moreover, known transmissions typically drive the display object at a constant rotational velocity. It has been determined that it is an advantage to provide an apparatus for displaying a point-of-purchase display object so that the display object rotates at a varying velocity. The varying or non-constant velocity of the display object increases the noticeability of the object to prospective purchasers.

Accordingly, the invention provides a point-of-purchase advertising display including a housing for supporting a battery or batteries that are adapted to be mounted in the housing to provide power to the apparatus. A low power d.c. motor is mounted on the housing and includes a rotor and rotor shaft assembly rotatable about an axis. The rotor shaft has mounted thereon a display object that rotates with the rotor shaft.

The advertising display also includes a control circuit connecting the batteries to the motor. The control circuit transmits power to the motor to cause sequential excitation of the motor. Specifically, a series of electrical pulses are transmitted to the motor to sequentially energize the motor in a manner described below. The control circuit includes an oscillator/divider circuit connected to the battery. The oscillator/divider generates an oscillating square-wave that is output to a driver. A resistor is connected to the oscillator/divider to adjust the frequency of the oscillating square-wave. The oscillator/divider is preferably an integrated circuit, and the duty cycle of the oscillating square-wave being output by the integrated circuit is typically set during the manufacture of the integrated circuit. The driver is connected to the motor and generates, in response to the oscillating square-wave, an output that has an identical frequency and an identical duty cycle but that possesses sufficient energy to cause energization of the motor and rotation of the rotor and rotor shaft as well as the display object driven by the rotor shaft. Preferably, the oscillating square-wave causes sequential energization of the motor and results in rotation of the display object at a varying velocity so that the display accelerates when the motor is energized by a pulse and decelerates between pulses. The control circuit is also useful in controlling both geared and non-geared motors in applications where a timed "ON" and "OFF" operation is desired, i.e., room deodorizer fans, industrial uses, etc.

A principal feature of the invention is the provision of an apparatus for connecting a point-of-purchase display object to a motor for rotation at a reduced velocity, thereby eliminating the need for a complex and expensive gear train.

Another feature of the invention is the provision of an apparatus that achieves a relatively low power consumption of the energy source.

Another feature of the invention is the provision of an apparatus capable of rotating a display object at a varying velocity, which apparatus is simple and inexpensive.

Another feature of the invention is an apparatus for rotating a display object, which apparatus is adaptable to a variety of applications.

Other features and advantages of the invention will become apparent to those skilled in the art upon review of the following detailed description, claims and drawings.

Figure 1:
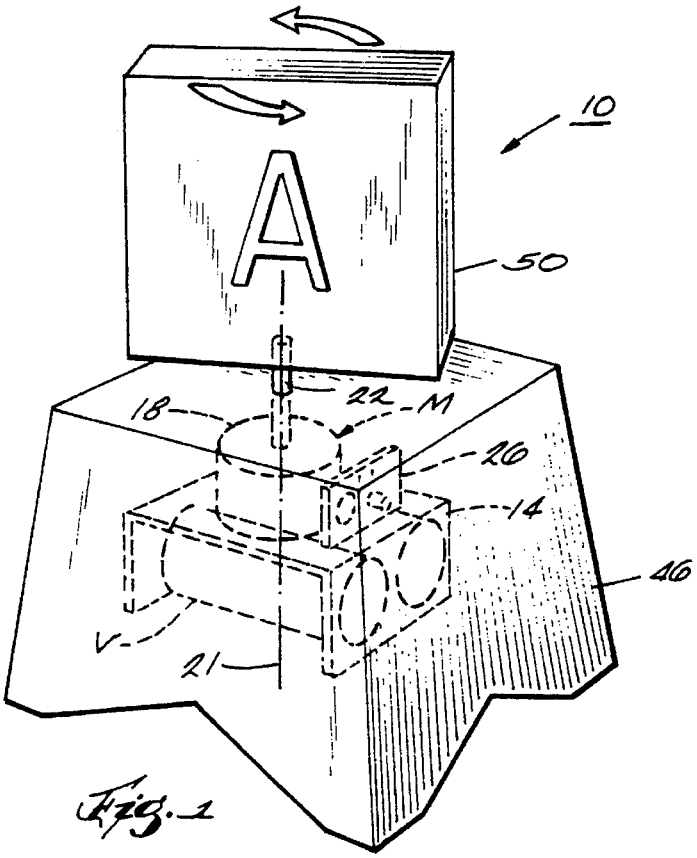
FIG. 1 is a perspective view of an apparatus embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

DESCRIPTION OF THE PREFERRED EMBODIMENTS

Shown in FIG. 1 of the drawings is a point-of-purchase display 10 embodying the invention. The display 10 includes a housing 14. The housing 14 supports a direct current ("d.c.") energy source V. Any known electrical energy source can be used provided that the output is within a range of between 1.5 to 6 volts d.c. Preferably, the energy source V is a pair of conventional, commercially available lead-acid batteries serially connected to have a voltage output of approximately three volts d.c. The housing 14 includes a set of terminals 15 and 16 (shown in FIGS. 2 and 3) that are electrically connected to the batteries when the batteries are mounted within the housing 14.

The display 10 also includes a miniature, permanent magnet, low power, direct current, brush-type motor M. The motor M has a motor housing 18 mounted on the housing 14. The motor M has a pair of terminals 19 and 20. A rotor shaft 22 is supported by the motor housing 18 for rotation about an axis 21. A rotor (not shown) is mounted on the rotor shaft 22, and, as is commonly known in the art, electrical excitation or energization of the motor M causes rotation of the rotor and rotor shaft 22 about the axis. The particular details of the motor M form no part of the invention and will not be described in greater detail.

Figure 2:
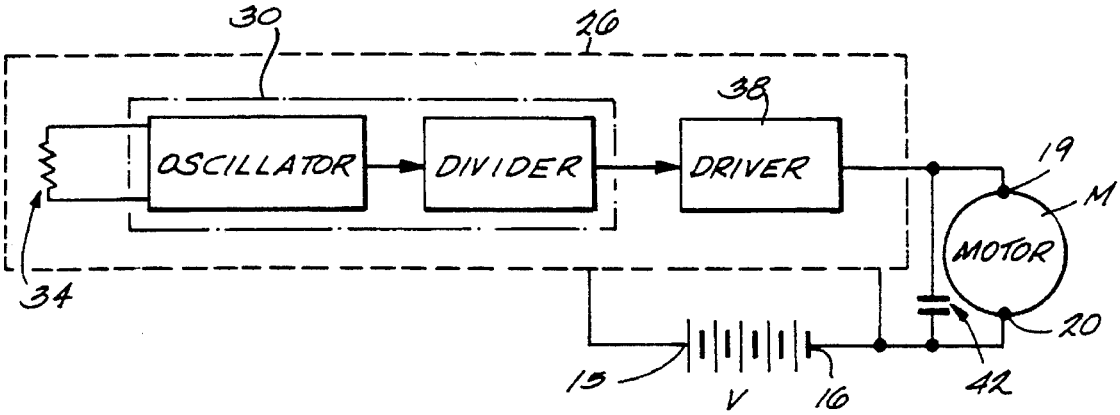
FIG. 2 is a schematic diagram of a digital control circuit for controlling the rotation of the display object of the apparatus.

As shown in FIG. 2, the point-of-purchase display 10 also includes a control circuit 26 for transmitting electrical power from the energy source V to the motor M. The control circuit 26 is connected to the terminals on the housing 14 and includes a commercially available and commonly known low-power, CMOS oscillator/divider 30. The oscillator/divider 30 generates a predetermined series of regularly timed energy pulses in the form of an oscillating square-wave signal output having a selected duty cycle and frequency.

The duty cycle of the oscillator/divider 30 output is set during the manufacture of the integrated circuit. A timing resistor 34 is connected to the oscillator/divider to set the frequency of the output of the oscillator/divider. As is known in the art, connection of resistors having different values results in the generation by the oscillator/divider 30 of square-wave outputs having different frequencies. Selection of the frequency is a function of the load on the motor M and the speed at which it is desired to drive the load. If the frequency is too high, the display object will rotate too quickly and as a result will not be easily readable. On the other hand, a low frequency may result in a signal possessing too little energy to actually drive the motor M. For these reasons, it is important that the precise frequency of the oscillator/divider 30 can be varied according to the application.

The output from the oscillator/divider 30 is connected to a driver or amplifier 38 that generates a signal having the same frequency and square-wave duty cycle but which now has sufficient power to drive the motor M of the point-of-purchase display. In the preferred embodiment, the driver 38 is a commercially available 2N4403 small signal transistor.

The motor terminal 19 is connected to the output of the driver 38 to receive the square-wave output of the driver 38. The terminal 20 is connected to the negative battery terminal 16. A capacitor 42 is connected across the motor terminals 19 and 20 to reduce radio frequency ("r.f.") noise that is commonly generated by electric motors.

The point-of-purchase display 10 also includes a shell or structure 46 to conceal the housing 14, the batteries, the motor M and the control circuit 26. The shell 46 forms no part of the invention and will not be described in greater detail. The rotor shaft 22 extends through the shell 46 and a display object 50 is mounted on the rotor shaft 22 for rotation therewith.

In operation, energy is transmitted from the batteries to power the oscillator/divider and driver circuits 30 and 38. The oscillator/divider 30 generates the predetermined series of regularly timed energy pulses in the form of an oscillating square-wave having a selected duty cycle and frequency. The output of the oscillator/divider 30 is transmitted to the driver 38. The driver 38 generates a square-wave output that has the same frequency and duty cycle as the input to the driver 38 but that now has sufficient power to energize the motor M.

With the receipt of the leading edge of each pulse of the driver output, the motor M is energized and the rotor and rotor shaft 22 rotate about the axis to drive the display object 50 or other load. Between pulses, the motor M ceases to be energized. Depending upon the load on the shaft (which, in the case of a point-of-purchase display, is a function of the weight of the display object) and the amount of time between the driver pulses (a function of both the frequency and the duty cycle of the signal), the display object will slow and perhaps even come to a complete stop. Alternatively, the slowing of the display object may not even be perceptible and the speed of the rotating display object may appear constant. The ability to tune the frequency creates a versatile display for use in many different applications. For example, the display can be used where relatively continuous rotation of the display object 50 is desired, or where it is desired to vary the velocity of the rotating display object 50 so as to increase the visibility thereof, or where it is desired to rotate the display object 50 in a continuous stop and start manner.

Figure 3:
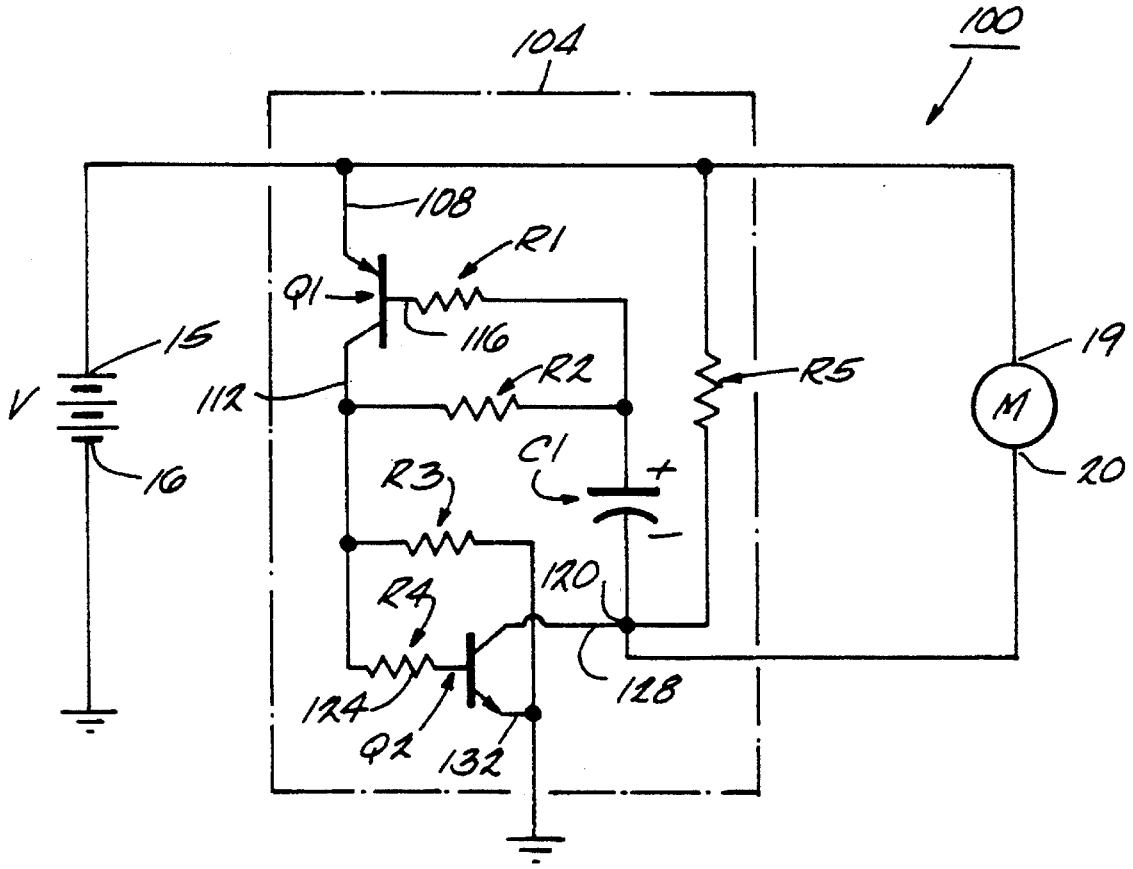
FIG. 3 is a schematic diagram of an apparatus that is another embodiment of the invention, the apparatus having an analog control circuit.

Shown schematically in FIG. 3 of the drawings is an apparatus 100 that is another embodiment of the invention. Like parts are identified using like reference numerals. The display apparatus 100 includes a motor M and an analog control circuit 104 for sequentially energizing the motor, to cause rotation of the rotor shaft at a varying velocity, by providing an alternating electrical signal to the motor. The control circuit 104 is capable of generating a signal having a selected frequency and a selected duty cycle and is connected to an energy source V as described above with respect to the control circuit 26 shown in FIG. 2.

The control circuit 104 includes a switching circuit for supplying current, preferably in the form of electrical energy pulses having the selected frequency and duty cycle, to the motor. The switching circuit includes a p-n-p transistor Q1. As is known in the art, the transistor includes an emitter 108, a collector 112 and a base 116. The emitter 108 is connected to the positive terminal 15 of the energy source V. The negative terminal 16 of the energy source V is connected to a common or ground connection.

The switching circuit also includes an n-p-n transistor Q2. The transistor Q2 includes a base 124, a collector 128 and an emitter 132. As shown in FIG. 3, the switching circuit includes a resistor R4 connected between the base 124 of transistor Q2 and the collector 112 of transistor Q1. A resistor R3 is connected between the collector 112 and the emitter 132, and the emitter 132 is in turn connected to a common or ground connection.

The control circuit also includes a timing circuit. The timing circuit includes a capacitor C1 having positive and negative terminals and a resistor R1 connected between the base 116 of transistor Q1 and the positive terminal of capacitor C1. As shown in FIG. 3, a resistor R2 is connected between the positive terminal of capacitor C1 and the collector 112 of transistor Q1. The resistors R2 and R1 and the capacitor C1 actuate the switching circuit in a manner to be described in greater detail below. The collector 128 of transistor Q2 is connected to the negative terminal of capacitor C1 at a node 120. Resistor R5 is connected between the node 120 and the emitter 108 of transistor Q1.

The motor M is connected in parallel with the resistor R5. Specifically, terminal 19 is connected to terminal 15 and terminal 20 is connected to the node 120. The motor M is identical to the motor described above with respect to the apparatus 10.

In operation, the analog control circuit 104 sequentially energizes the motor M to achieve a slower rotor shaft speed, thereby eliminating the need for a gear train and reducing the power consumption of the circuit to extend battery life.

Specifically, when the circuit is connected to the energy source, the base-emitter voltage is low (i.e., below the threshold required to turn Q1 "ON"). Accordingly, transistor Q1 turns "ON" to conduct current from the emitter 108 to the collector 112. The current flowing through transistor Q1 reaches the base 124 of transistor Q2 through biasing resistor R4. Preferably, R3 is much greater than R4 to substantially prevent loss of the current from Q1 through R3. The current flowing to base 124 creates a potential across resistor R4 that biases transistor Q2 to the "ON" state so that current flows from the battery V, through the motor M to the collector 128 of transistor Q2 and through the transistor Q2 to the emitter 132 and to ground. Preferably, the transistors Q1 and Q2 operate in the "switch mode", i.e., in the saturation portion of the characteristic curve of the component. The current flowing through the motor M energizes the motor M.

Simultaneous to the conduction of current through the motor M and through transistor Q2 to common, current flows from the collector 112 through R2 to charge capacitor C1. As the potential on capacitor C1 increases, the potential eventually exceeds the threshold base-emitter voltage for transistor Q1 and turns transistor Q1 "OFF". Because transistor Q1 is no longer conducting, the biasing current ceases to flow to transistor Q2 and the biasing potential at transistor Q2 is eliminated. Accordingly, transistor Q2 turns "OFF" and current ceases to flow through motor M. Capacitor C1 then begins to discharge through resistors R2 and R3 to ground thereby reducing the base-emitter potential. Transistor Q1 remains "OFF" until the base-emitter voltage again drops below the threshold to turn "ON" transistor Q1 and repeat the cycle. Though resistors R3 and R4 have some effect on the timing of the circuit, the frequency and duty cycle of the circuit are preferably controlled by a precise selection of the values for resistors R1 and R2 and capacitor C1.

The duty cycle of the output signal sequentially energizing the motor M is dependent upon the values of the capacitor C1 and the resistor R1. The frequency of the output signal is a function of R2. Thus, both the frequency and duty cycle of the analog control circuit 104 may be adjusted to accommodate varying loads on the rotor shaft 22. This is an advantage because the velocity of the rotor shaft 22 is a function of the load on the shaft, and the duration for which the motor is energized. The duration is in turn a function of the frequency and duty cycle of the output. Therefore, the ability to adjust both the frequency and the duty cycle results in a very versatile control circuit 104 for the point-of-purchase display. As an example, the typical component values chosen for a very light load such as a 3 inch by 3 inch display card are as follow:

C1=47.0 micro-farads

R1=1500 ohms

R2=51000 ohms.

Use of these components values results in a shaft rotation of between 360° and 720° approximately twenty times per minute.

Various features and advantages of the invention are set forth in the following claims.

We claim:

1. An advertising display comprising:

a display object including advertising material;

a motor for rotating said object about a rotation axis at a varying velocity and having a housing and a drive shaft rotatably supported by said housing and drivingly connected to said display object; and a control circuit coupled to said motor, the control circuit being adapted to be connected to a direct current energy source, and including an oscillator connected to said energy source for generating a predetermined series of regularly timed energy pulses having a selected frequency and duty cycle to cause excitation of said motor in response to said energy pulses.

2. An advertising display as set forth in claim 1 wherein said control circuit further comprises a driver connected between said oscillator and said motor for transmitting said energy pulses from said oscillator to said motor.

3. An advertising display as set forth in claim 1 and further comprising means for rotating said object at a varying velocity.

4. An advertising display comprising:

a display object including advertising material;

means for supporting said display object for rotation about an axis, said means including a motor having a housing and a rotor shaft rotatably supported by said housing and connected to said display object; and rotating means for rotating said object about said axis at a varying velocity, said rotating means including a control circuit coupled to said motor, the control circuit being adapted to be connected to a direct current energy source so as to generate a predetermined series of regularly timed energy pulses having a selected frequency and duty cycle to cause excitation of said motor in response to said energy pulses.

5. An advertising display as set forth in claim 4 wherein said control circuit includes an oscillator connected to said energy source for generating said predetermined series of regularly timed energy pulses to cause excitation of said motor.

6. An advertising display as set forth in claim 5 wherein said means for energizing said motor further comprises a driver connected between said oscillator and said motor for transmitting said energy pulses from said oscillator to said motor.

7. An advertising display as set forth in claim 4 wherein said control circuit includes an oscillator connected to said energy source for generating said predetermined series of regularly timed energy pulses, and a driver connected between said oscillator and said motor for transmitting said energy pulses from said oscillator to said motor.

8. An apparatus as set forth in claim 4 wherein said control circuit includes switching circuit means for supplying said energy pulses to said motor, and means for actuating said switching circuit means at said frequency and said duty cycle.

9. An apparatus as set forth in claim 8 wherein said means for actuating said switching circuit means includes timing circuit means for establishing said frequency and said duty cycle.

10. An apparatus as set forth in claim 9 wherein said timing circuit means includes first impedance means for establishing said frequency and second impedance means for establishing said duty cycle.

11. An apparatus as set forth in claim 10 wherein said first impedance means comprises a resistance and wherein said second impedance means comprises a capacitance.

12. An apparatus as set forth in claim 11 wherein said switch means includes a first transistor connected to said timing circuit means, and for providing an oscillating biasing signal, and a second transistor for supplying current to the motor to sequentially energize the motor in response to said biasing signal from said first transistor.

13. An apparatus comprising:

a housing;

a shaft rotatably supported by said housing;

an advertising display object connected to said shaft and including advertising material;.

an electric motor coupled to said shaft for rotating said shaft about an axis; and control circuit means for sequentially energizing the motor to cause rotation of the display object at a varying velocity and for providing an alternating electrical signal to said motor, said signal having a selected frequency and a selected duty cycle.

14. An apparatus as set forth in claim 13 wherein said control circuit means is adapted to be connected to an energy source and includes switching circuit means for supplying current from said energy source to said motor, and means for actuating said switching circuit means at said frequency and said duty cycle.

15. An apparatus as set forth in claim 14 wherein said means for actuating said switching circuit means includes timing circuit means for establishing said frequency and said duty cycle.

16. An apparatus as set forth in claim 15 wherein said timing circuit means includes first impedance means for establishing said frequency and second impedance means for establishing said duty cycle.

17. An apparatus as set forth in claim 16 wherein said first impedance means comprises a resistance and wherein said second impedance means comprises a capacitance.

18. An apparatus as set forth in claim 17 wherein said switch means includes a first transistor connected to said timing circuit means, and for providing an oscillating biasing signal, and a second transistor for supplying current to the motor to sequentially energize the motor in response to said biasing signal from said first transistor.

19. A method of displaying an object including advertising material, said method comprising the steps of:

(A) providing an object including advertising material;

(B) providing a motor having a housing and a rotor shaft rotatably supported by said housing for rotation about an axis;

(C) connecting said object to said rotor shaft;

(D) generating a predetermined series of regularly timed energy pulses, said pulses having a selected frequency and a selected duty cycle; and (E) energizing said motor with said predetermined series of regularly timed energy pulses so as to rotate said object about said axis at a varying velocity.

* * * * *